United States Patent [19]

Krieger et al.

[11] Patent Number: 4,741,290

[45] Date of Patent: May 3, 1988

[54] PROCESS FOR THE COMBUSTION OF CARBONACEOUS MATERIALS IN A CIRCULATING FLUIDIZED BED, AND FLUIDIZED BED FURNACE INSTALLATION FOR PERFORMING THE PROCESS

[75] Inventors: Ernst Krieger, Waldbrol; Karl Ihne, Wiehl, both of Fed. Rep. of Germany

[73] Assignee: L. & C. Steinmuller GmbH, Gummersbach, Fed. Rep. of Germany

[21] Appl. No.: 79,111

[22] Filed: Jul. 28, 1987

[30] Foreign Application Priority Data

Jul. 31, 1986 [DE] Fed. Rep. of Germany ..... 3625992

[51] Int. Cl.[4] ..... F22B 1/00

[52] U.S. Cl. ..... 122/4 D; 110/245; 165/104.16

[58] Field of Search ..... 122/4 D, 7 R; 110/245, 110/347; 165/104.16

[56] References Cited

U.S. PATENT DOCUMENTS 4,111,158 9/1978 Reh et al. ..... 122/4 D
4,471,723 9/1984 Chrysostome ..... 122/4 D
4,522,154 6/1985 Taylor et al. ..... 122/4 D
4,665,865 5/1987 Zubrod ..... 122/4 D X
4,682,567 7/1987 Garcia-Mallol et al. ..... 122/4 D

FOREIGN PATENT DOCUMENTS 0158033 10/1985 European Pat. Off. .
2539546 3/1977 Fed. Rep. of Germany .

*Primary Examiner*—Edward G. Favors
*Attorney, Agent, or Firm*—Young & Thompson

[57] ABSTRACT

In a process and a fluidized bed furnace installation for performing the process for the combustion of carbonaceous materials in a fluidized bed reactor with an atmospheric or pressurized, circulating fluidized bed, wherein solids are circulated in a circulation system consisting of a fluidized bed reactor, at least one separator, and at least one return line, and wherein solids are withdrawn from the circulation system, and wherein the stack gases are discharged downstream of the separator, and wherein combustion heat is removed at least by way of heating surfaces of the fluidized bed reactor and by way of stack-gas-exposed heating surfaces downstream of the separator, the invention provides that a partial stream of solids withdrawn from the circulation system is admixed to the stack gases or waste gases, exiting from the separator, upstream of the heating surfaces for the removal of heat from the stack gases.

7 Claims, 2 Drawing Sheets

Figures 1, 2:
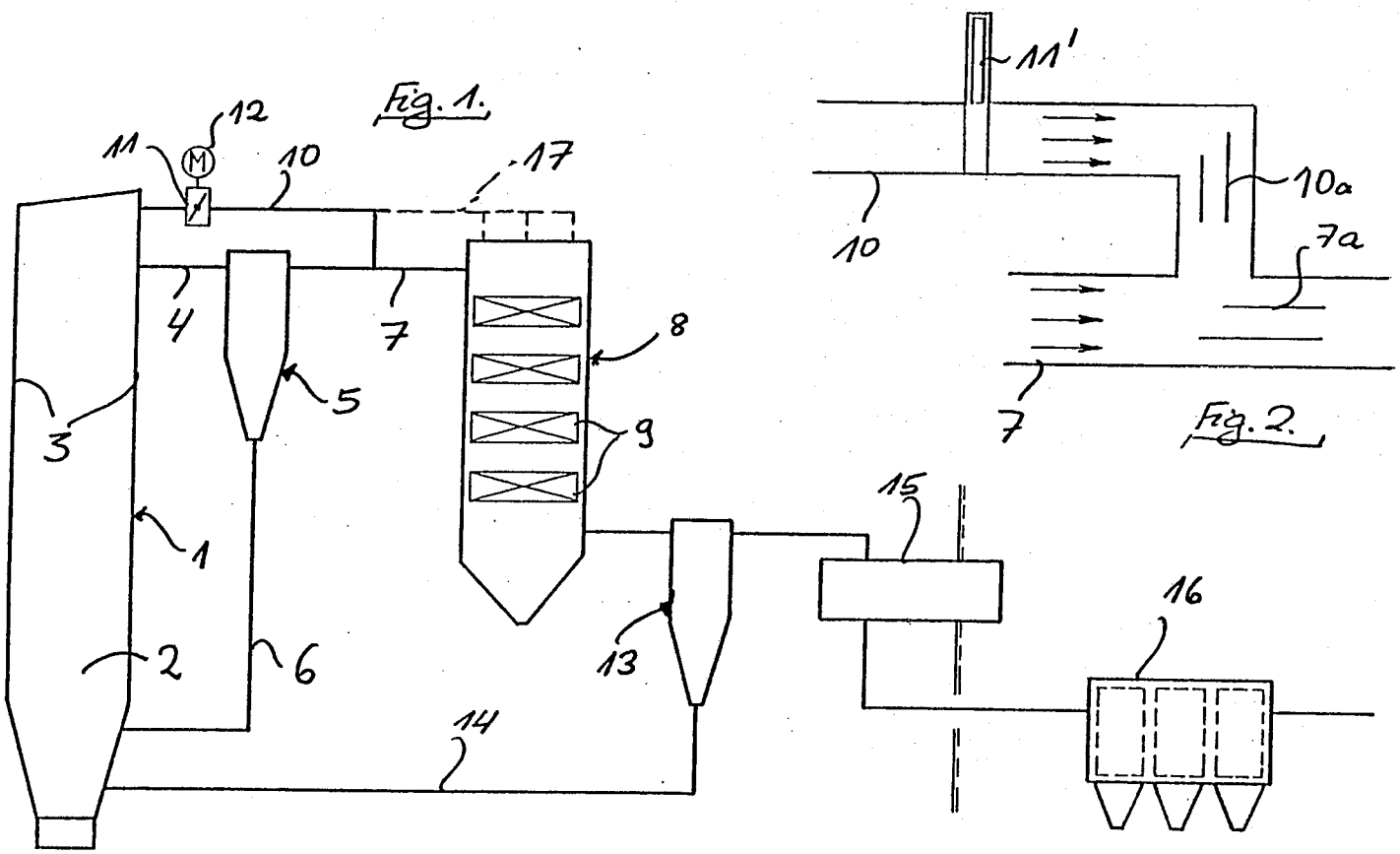

1
2
3
4
5
6
7
8
9
10
11
12
13
14
15
16
17
7a
10a
11'

PROCESS FOR THE COMBUSTION OF CARBONACEOUS MATERIALS IN A CIRCULATING FLUIDIZED BED, AND FLUIDIZED BED FURNACE INSTALLATION FOR PERFORMING THE PROCESS

The invention relates to a process and apparatus for the combustion of carbonaceous materials in a circulating fluidizing bed.

Such a process has been known, for example, from German Patent No. 2,539,546. In the combustion of carbonaceous materials in a circulating fluidized bed, the firing is conducted so that a temperature in a range of 850° C. is maintained in the fluidized bed reactor in order to adhere to the emission values required in the operation of such an installation. This is also the temperature at which the waste gases are discharged from the separator and are conducted to the cooling surfaces provided for removal of heat from the pure gases. Consequently, the flue gas temperature of about 850° C. ensuing from the process also necessarily determines the heat supply for the waste heat removal unit connected downstream in the separator. The waste heat disposal unit usually consists of a convection flue with feedwater preheating surfaces, evaporator surfaces, superheater surfaces and/or intermediate superheater heating surfaces. It is furthermore customary to arrange additionally an air heater downstream of the convection flue. Since the amount of heat available downstream of the separator generally is inadequate for the subsequently arranged components, it is necessary to provide additional superheater and intermediate superheater heating surfaces in the fluidized bed reactor proper or in separate ash fluidized bed coolers. On account of the solids content in the flue gases in the fluidized bed reactor of up to about one hundred times the amount of fuel utilized, it is necessary to provide for such heating surfaces additional measures to prevent wear, such as enlarged wall thicknesses, protective shells, and linings, and furthermore, high-quality and expensive materials must be used on account of the high thermal stresses. Also, it is to be assumed that the heating surfaces arranged in the flue gas stream of the fluidized bed reactor will have to be replaced after an operating period limited in time. Ash fluidized bed coolers in the shape of separate components lead to considerable expenditure in apparatus and control technique.

It is, therefore, an object of the present invention to indicate a process wherein the amount of heat downstream of the separator can be increased without a change in the flue gas temperature so that the heat supply in the flue gases is adequate downstream of the separator.

This object has been attained by providing that a partial stream of solids withdrawn from the circulation system is admixed to the flue gases or waste gases exiting from the separator upstream of the heating surfaces for removing heat from the flue gases.

By the admixture of a partial solids stream into the gases leaving the separator, the amount of heat available downstream of the separator is increased without there being any change in the flue gas temperature.

With this mode of operation, an additional installation of heating surfaces, especially superheater and/or intermediate superheater heating surfaces in the fluidized bed reactor is avoided, and there is no need for a separate ash fluidized bed cooler.

In a preferred mode of carrying out the process, the partial stream of solids is withdrawn together with waste gas from the circulation system between the fluidized bed reactor and the separator and readmixed to the pure gas stream downstream of the separator. The required bypass quantity of the dust-laden flue gas is regulated and accordingly adapted to the respectively required steam temperature.

Although the conductance of a bypass stream is preferred, it is also possible to supply the additional amount of heat, needed at the heating surfaces arranged after the separator during the heat removal, by introducing ash through nozzles into the treated flue gas stream; this ash can be taken, for example, from the return conduit.

It is furthermore advantageous to provide that the partial stream of solids introduced into the flue gas is separated from the flue gas after its cooling and recycled into the fluidized bed reactor. By cooling to a temperature range of, for example, 300° C., a desired reduction of the fluidized bed temperature is attained during recycling into the fluidized bed zone.

The invention is likewise directed to a fluidized bed furnace installation for performing the process of this invention. For this purpose, the invention is based on a fluidized bed furnace installation with a circulation system, consisting at least of a fluidized bed reactor with at least one heating surface, a separator arranged downstream of the latter, and a return line from the separator to the fluidized bed reactor, and a waste heat disposal unit arranged downstream of the separator on the flue gas side.

The fluidized bed furnace installation according to this invention is characterized in that a device is provided for removing a partial stream of solids from the circulation system and a device is furthermore provided for admixing the partial solids stream into the flue gases exiting from the separator. Further dependent claims are directed to preferred embodiments of the fluidized bed furnace installation.

Figure 3:
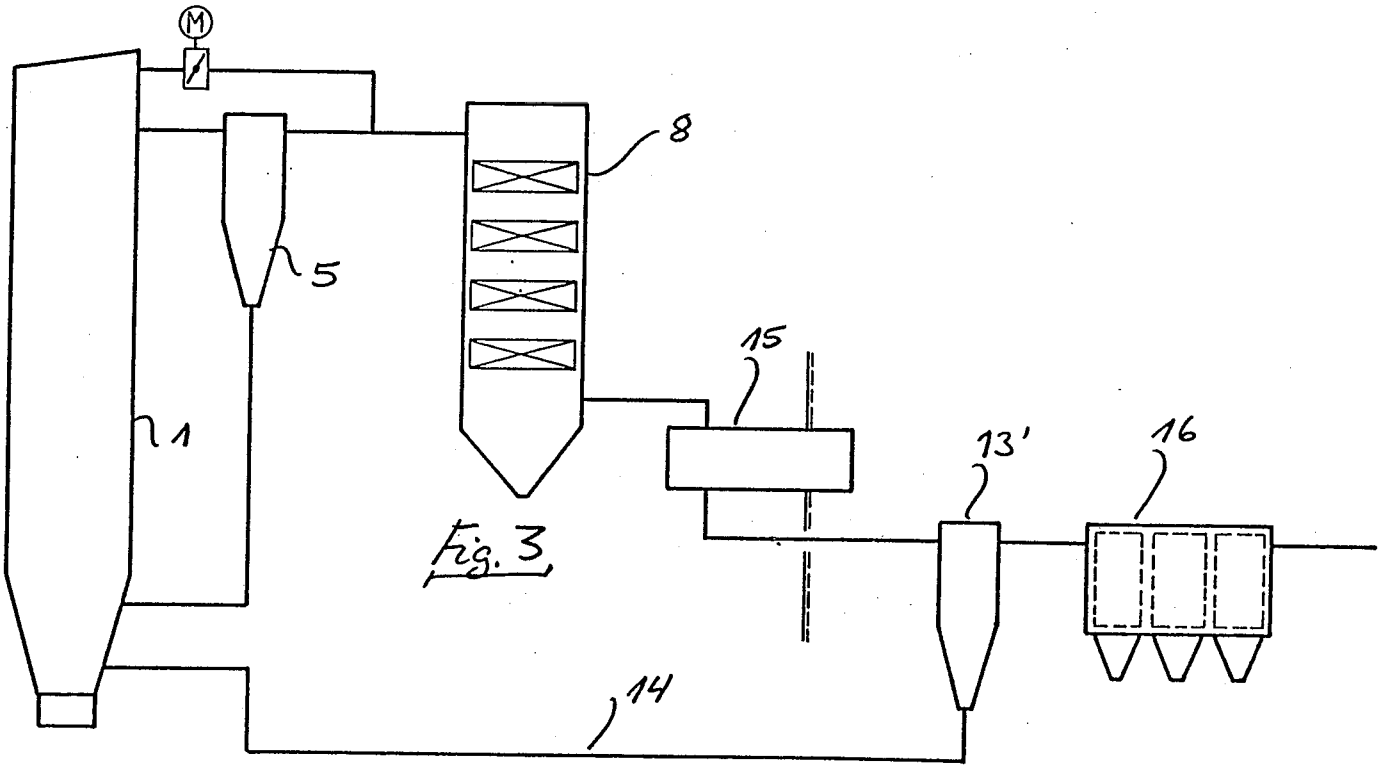

The invention will now be described in greater detail with reference to the appended figures wherein:

FIG. 1 is a block diagram of a first embodiment of a steam generator with circulating fluidized bed firing, FIG. 2 is an enlarged fragmentary view of a section of FIG. 1, and FIG. 3 shows a further embodiment.

The steam generator comprises a fluidized bed reactor 1 with fluidized combustion chamber 2, delimited by a wall lining of evaporator tubes 3. An ash precipitator 5 is connected to the fluidized bed chamber by way of a raw gas duct 4. The solids discharge unit of the separator 5 is connected by way of a return line 6 to the fluidized combustion chamber while this discharge unit is connected on the treated gas side, via a connecting duct 7, to a waste heat stack gas flue 8 wherein several heating surfaces 9 are arranged.

The separator 5 is associated with a flue gas bypass conduit 10 connecting the fluidized combustion chamber 2 with the treated gas duct 7; in this bypass conduit, a regulating unit 11 is provided, illustrated in FIG. 1 as a flap, which unit can be adjusted by means of a motor 12.

The stack gas leaving the stack gas flue 8 is conducted via a separator 13, the solids outlet of which is connected via a conduit 14 to the fluidized bed combustion chamber 2. The gas exiting from the separator 13 is conducted via an air preheater 15, a dust filter 16, and from there to the stack, not shown.

In the illustration of a detail according to FIG. 2, a plate 11' which can be advanced into the conduit 10 is provided as the regulating unit. In order to facilitate the guidance and mixing in of the solids-laden flue gas stream, baffles 10*a*, 7*a* are preferably arranged in the end section of conduit 10 as well as in the mixing zone of conduit 7.

The embodiment according to FIG. 3 differs from the embodiment of FIG. 2 in that the separator 13' is located between the air preheater 15 and the dust filter 16.

Furthermore, FIG. 1 illustrates in dashed lines that mixing in of the solids-laden flue gas stream conducted past the separator 5 need not take place in a conduit upstream of the stack gas flue 8, but rather mixing in can also be conducted by way of one or several sectional conduits 17 directly into the stack gas flue 8.

The following is set forth as an example for the dust load on the stack gases conducted through the stack gas flue 8 according to this invention: 1.0 kg/Nm$^3$ if intermediate superheating is provided, and 0.5 kg/Nm$^3$ if no intermediate superheating is included. It can be assumed that with this dust load there will be no undue erosions since the dust load in this case is merely a fraction of the dust load to which bulkhead heating surfaces are exposed in the stack gas flue upstream of the cyclone separator. Separate forcible conveying devices in the flue gas line 10 are not required since the pressure loss in the cyclone separator 5 in the recirculation system is enough for transporting the necessary partial stream of flue gas via conduit 10 to the treated gas duct 7.

What is claimed is:

1. Process for the combustion of carbonaceous materials in a fluidized bed reactor with an atmospheric or pressurized, circulating fluidized bed wherein solids are circulated in a circulation system consisting of the fluidized bed reactor, at least one separator, and at least one return line, and solids are withdrawn from the circulation system, and wherein the flue gases are discharged downstream of the separator, and wherein combustion heat is removed at least by way of heating surfaces of the fluidized bed reactor and by way of stack-gas-exposed heating surfaces downstream of the separator, characterized in that a partial stream of solids withdrawn from the circulation system is admixed to the stack gases or waste gases, exiting from the separator, upstream of the heating surfaces for the removal of heat from the stack gases.

2. Process according to claim 1, characterized in that the partial stream of solids is withdrawn together with waste gas from the circulation system between the fluidized bed reactor and the separator, and is readmixed to the treated gas stream downstream of the separator.

3. Process according to claim 1, characterized in that the partial stream of solids introduced into the stack gas is separated from the stack gas after its cooling and recycled into the fluidized bed reactor.

4. Fluidized bed furnace installation, especially steam generator, with a circulation system at least consisting of a fluidized bed reactor with at least one heating surface, a separator arranged downstream thereof, and a return line from the separator to the fluidized bed reactor, and with a waste heat disposal unit connected downstream of the separator on the waste gas side, characterized in that a device (10) is provided for withdrawing a partial stream of solids from the circulation system (3, 4, 5, 6) and a device is furthermore provided for admixing the partial stream of solids into the stack gases (7) exiting from the separator (5).

5. Fluidized bed furnace installation according to claim 4, characterized in that the separator (5) is associated with a bypass conduit (10) on the stack gas side.

6. Fluidized bed furnace installation according to claim 4, characterized in that the waste heat disposal unit consists of a stack gas flue (8) with heating surfaces (9) and of an air preheater (15) optionally connected downstream thereof, and the solids can be introduced upstream of the stack gas flue (8) and/or upstream of the air preheater (15).

7. Apparatus according to claim 4, characterized in that a separator (13; 13') is arranged downstream of the waste heat disposal unit, this separator being connected on the solids side with the fluidized bed reactor (1) and on the gas side with a dust filter (16).

* * * * *